United States Patent [19]

Rüge et al.

[11] Patent Number: 4,828,191

[45] Date of Patent: May 9, 1989

[54] METHOD FOR SORTING CHEESES ON AN AUTOMATIC WINDING MACHINE

[75] Inventors: Joachim Rüge; Ludwig Neuhaus, both of Monchen-Gladbach; Gregor Kathke, Viersen; Ferdinand-Josef Hermanns, Erkelenz; Gregor Gebald, Monchen-Gladbach, all of Fed. Rep. of Germany

[73] Assignee: W. Schlafhorst & Co., Monchen-Gladbach, Fed. Rep. of Germany

[21] Appl. No.: 194,488

[22] Filed: May 16, 1988

[30] Foreign Application Priority Data

May 16, 1987 [DE] Fed. Rep. of Germany ..... 3716473

[51] Int. Cl.[4] ..... B65H 54/02; B65H 61/00; B65H 63/00

[52] U.S. Cl. ..... 242/18 R; 242/18 DD; 242/36; 242/39

[58] Field of Search ..... 242/18 R, 36, 39, 35.5 R, 242/35.5 A, 28, 49, 18 DD

[56] References Cited

U.S. PATENT DOCUMENTS

| | | | |
|---|---|---|---|
| 4,351,494 | 9/1982 | Schippers et al. | 242/35.5 A |
| 4,373,266 | 2/1983 | Stutz | 242/36 X |
| 4,447,955 | 5/1984 | Stutz et al. | 242/36 X |
| 4,494,702 | 1/1985 | Miyake et al. | 242/18 R |
| 4,513,921 | 4/1985 | Imoda et al. | 242/36 |
| 4,538,772 | 9/1985 | Davies | 242/18 R |
| 4,553,708 | 11/1985 | Matsui et al. | 242/36 |
| 4,666,096 | 5/1987 | Heel et al. | 242/36 |
| 4,685,629 | 8/1987 | Sugioka | 242/18 R |
| 4,715,548 | 12/1987 | Miyake et al. | 242/18 R |
| 4,715,550 | 12/1987 | Erni et al. | 242/39 |

FOREIGN PATENT DOCUMENTS

| | | |
|---|---|---|
| 0026472 | 4/1981 | European Pat. Off. . |
| 0196090 | 10/1986 | European Pat. Off. . |
| 3111112 | 10/1982 | Fed. Rep. of Germany . |
| 3242318 | 6/1983 | Fed. Rep. of Germany . |
| 3438962 | 4/1986 | Fed. Rep. of Germany . |

*Primary Examiner*—Stanley N. Gilreath

*Attorney, Agent, or Firm*—Herbert L. Lerner; Laurence A. Greenberg

[57] ABSTRACT

A method for sorting cheeses on an automatic winding machine includes predetermining a set-point value ratio of yarn length to cheese diameter. An actual value ratio of yarn length to cheese diameter is automatically measured. The measured values are automatically compared with the set-point values. Cheeses for which the actual value ratio of yarn length to cheese diameter is within a predetermined range of the set-point value ratio are automatically selected as quality cheeses.

20 Claims, 1 Drawing Sheet

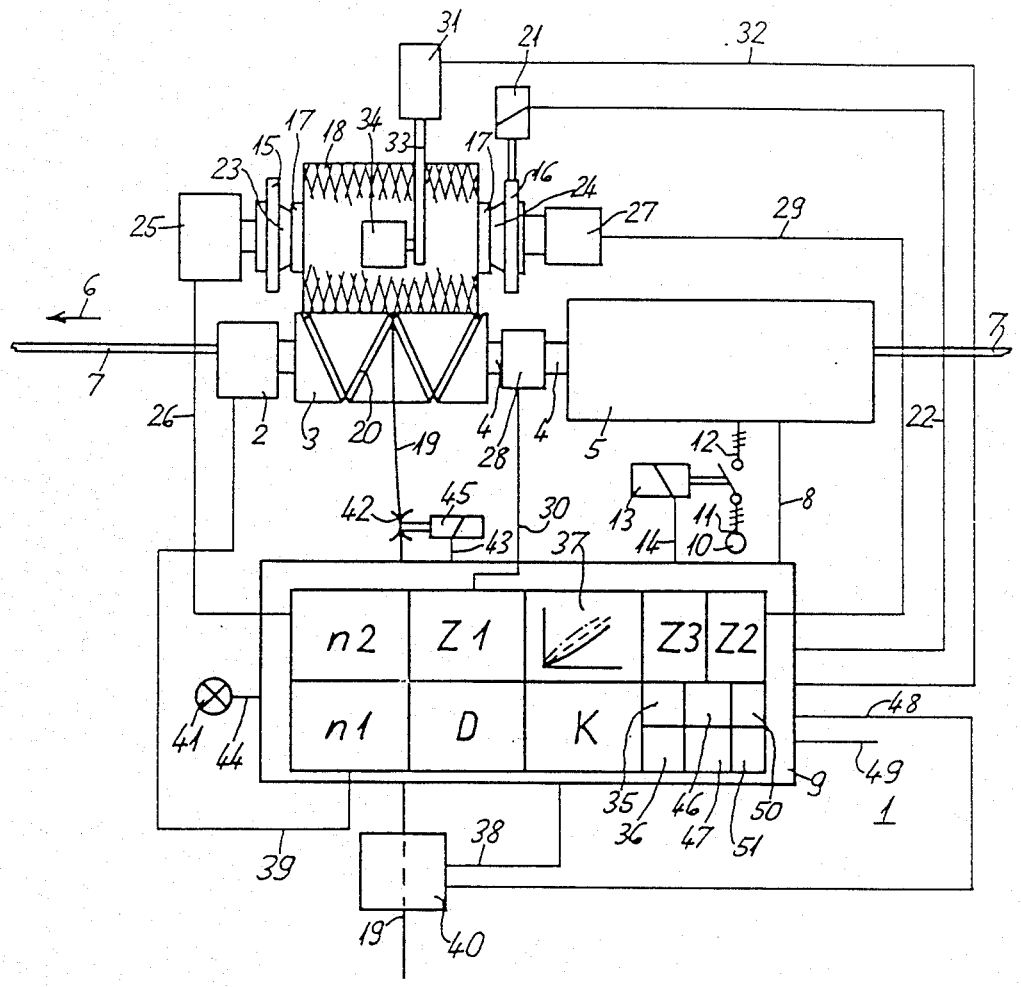
n2
Z1
Z3
Z2
n1
D
K

METHOD FOR SORTING CHEESES ON AN AUTOMATIC WINDING MACHINE

The invention relates to a method for sorting cheeses or cross-wound bobbins on an automatic winding machine.

Such conventional methods are not able to distinguish between higher and lower quality cheeses which are already disposed at the winding stations of the automatic winding machine.

It is accordingly an object of the invention to provide a method for sorting cheeses on an automatic winding machine, which overcomes the hereinafore-mentioned disadvantages of the heretofore-known methods of this general type and which distinguishes between cheeses of lesser and greater quality which are already at the winding stations of the automatic winding machine.

With the foregoing and other objects in view there is provided, in accordance with the invention, a method for sorting cheeses or cross-wound bobbins on an automatic winding machine, which comprises predetermining a set-point value ratio of yarn length to cheese diameter, automatically measuring an actual value ratio of yarn length to cheese diameter, automatically comparing the measured values with the set-point values, and automatically selecting cheeses for which the actual value ratio of yarn length to cheese diameter is within a predeterminable range of the set-point value ratio as quality or high-quality cheeses.

The bobbin density, which is otherwise only ascertainable with difficulty, if at all, is used according to the invention as the criterion for quality.

In accordance with another mode of the invention, the rotational angle or the number of rotations of a friction drum that is in frictional contact with the cheese or that drives the cheese is automatically measured, and the result of measurement is set equal to the yarn length, or automatically converted into some other yarn length measure, such as a metric one, and used for determining the actual ratio of yarn length to cheese diameter.

For practical reasons it is sufficient to measure or count the rotations of the friction drum or friction roller automatically and to set the result of measurement or counting equal to the yarn length. Likewise for practical reasons, a special measurement roller need not be brought into frictional contact with the cheese if the cheese is already driven by a friction roller or friction drum.

The yarn length ascertained in this way may deviate from the true yarn length by a measurement tolerance. It is advantageous to convert the result of the measurement into a metric yarn length measure, for example, especially if the measured yarn length is used to draw a conclusion as to the true yarn length. In practice, a process computer is already used at the machine, so that a suitable computer program can easily be written.

In accordance with a further mode of the invention, the rpm of the cheese and of a friction drum that is in frictional contact with the cheese or that drives the cheese are measured automatically and set into a ratio with one another. The ratio of the rpm of the cheese to the rpm of the friction drum is used for calculating the cheese diameter or is automatically converted into some other measure, for example a metric measure, of the cheese diameter and is used for determining the actual ratio of yarn length to the cheese diameter.

Expressing the cheese diameter in a metric measure is basically important only if the cheese diameter is to be automatically displayed or printed out with the aid of a process computer, by means of a printer connected thereto.

It is simplest if the quality criterion of "bobbin density" is ascertained at the end of the winding process. The cheeses of good quality are then separated from the few other cheeses of lower quality.

In accordance with an added mode of the invention, upon ascertaining the yarn length and/or the cheese diameter, the measurement values used for this purpose are automatically corrected by correction values for the slip between the friction drum and cheese, and/or for conicity of the cheese, and/or for the maximum diameter of the cheese and/or the type and surface quality of the friction drum and/or the yarn type and/or the angle at which the yarn windings intersect.

The corrections are especially important if the true yarn length and the true cheese diameter are to be ascertained, displayed or printed out. However, correction values are also useful for making the quality determination more precise.

In accordance with an additional mode of the invention, the actual ratio of yarn length to cheese diameter is ascertained continuously during the bobbin travel and compared with set-point values. It thereby becomes possible to determine the tendency being taken in terms of the standard of quality of the bobbin, even during the buildup of the bobbin. If necessary, an intervention can already be made at such a time during the winding operation, such as by shutting down the winding station and emitting a warning signal.

In accordance with yet another mode of the invention, the winding tension of the yarn is automatically controlled for influencing the instantaneous actual ratio of yarn length to cheese diameter. This effectively prevents the production of cheeses of lower quality.

In accordance with yet a further mode of the invention, a signal is automatically set at any winding station of the automatic winding machine at which the measured actual ratio of yarn length to cheese diameter is outside the range of the set-point values.

In a simpler embodiment, the signal is set as soon as the winding process has ended. With a more precise version, if the actual ratio of yarn length to cheese diameter is to be ascertained and recorded continuously during the bobbin travel, the signal can also be set even during the bobbin travel, and the winding process can be interrupted.

Automatic winding machines often have a special automatic unit that provides for the replacement of the cheese with an empty bobbin tube. Therefore, in accordance with yet an added mode of the invention, an automatic replacement of the cheese with an empty bobbin tube is prevented at any winding stations at which the measured actual ratio of yarn length to cheese diameter is outside the range of the set-point values. A determination as to whether or not this is the case can be made either during the bobbin travel or at the end of the winding process. Each cheese of lesser quality then remains in the winding station, is not automatically removed and must be removed from the winding station by hand as needed.

In accordance with yet an additional mode of the invention, in addition and as further criteria for the bobbin quality, the number of yarn breaks and/or the number of cuts performed by a yarn cleaner is automatically counted, and furthermore only those cheese in which the number of yarn breaks and/or the number of cuts of the cleaner during the bobbin travel does not exceed a predetermined maximum number, are automatically selected as high-quality cheeses.

Advantageously, in accordance with still another mode of the invention, at the end of one work shift, a survey of the number of quality cheeses produced at the individual winding stations of the automatic winding machine is displayed and/or printed out by means of an electronic informer. In addition to the automatic selection of the good cheeses, a survey of the effectiveness of the individual winding stations and the quality thereof is also obtained in this manner. The quality of the winding station itself has a decisive influence on the quality of cheeses produced in this winding station. Winding stations of lesser quality must be attended to by a maintenance crew or repaired or replaced in good time.

In accordance with still a further mode of the invention, a plurality of set-point values is predetermined from each set-point value category, and the high-quality cheeses are classified according to a correspondingly high number of quality levels.

Various criteria can be used to assign cheeses to quality levels. For example, the quality levels may take all of the quality criteria into account. However, there may also be quality levels in which only some of the relevant quality criteria or only certain individual quality criteria are used as a standard for the quality.

In accordance with a concomitant mode of the invention, the selected high-quality cheeses are marked or labeled in accordance with the quality characteristics thereof. This makes it impossible, or at least more difficult, to later mistake cheeses of different quality for one another.

Other features which are considered as characteristic for the invention are set forth in the appended claims.

Although the invention is illustrated and described herein as embodied in a method for sorting cheeses on an automatic winding machine, it is nevertheless not intended to be limited to the details shown, since various modifications may be made therein without departing from the spirit of the invention and within the scope and range of equivalents of the claims.

The method of operation of the invention, however, together with additional objects and advantages thereof will be best understood from the following description of specific embodiments when read in connection with the drawing.

The single figure of the drawing is a diagrammatic and block circuit diagram of an apparatus for carrying out the method according to the invention.

Referring now to the single figure of the drawing in detail, there is seen a winding station 1 of an automatic winding machine, which is not shown in all of its details. A friction roller 3 is driven through a shaft 4 by a motor 5, which forms the drive apparatus of the friction roller 3. A control line 8 connects the motor 5 to an electronic process computer 9. The motor 5 is supplied with operating voltage from a voltage source 10 through multiple-conductor lines 11, 12 and a switch protector 13, as long as the switch protector 13 is switched on. The switch protector 13 in the illustrated embodiment is at the same time part of a shutoff device of the winding station 1. A control line 14 connects the switch protector 13 to the process computer 9. The friction roller 3 has an rpm pickup 2, which is connected by means of a line 39 with an rpm meter n1, which in turn is connected to the process computer 9. A pivotably supported creel or bobbin frame 15, 16 carries the tube 17 of a take-up bobbin 18 which is in the form of a random-wound cheese. During the winding process, the periphery of the take-up bobbin 18 is driven by the friction roller 3. The take-up bobbin 18 rests on the friction roller 3 with a certain pressing force. The take-up bobbin 18 is supplied with a thread or yarn 19 by cross-winding or jigging back and forth. The cross-winding is accomplished by reversing thread grooves 20 in the friction roller 3. The reversing thread grooves 20 direct the yarn 19 in such a way that it changes continuously from left to right and back again during the winding process.

The creel 15, 16 can be opened and closed for removing a finished take-up bobbin 18 and inserting a new bobbin tube. The creel 15, 16 is also connected to an electromagnetic lifting device 21, which serves as a further shutoff device of the winding station 1. The lifting device 21 is connected by a control line 22 to the process computer 9.

Rotatable tube carrying elements 23, 24 are supported in the creel 15, 16. The tube carrying elements 23, 24 are conically tapered toward the bobbin tube 17, so as to be able to receive tubes of different diameter. Located on the rotatable tube carrying element 23 is an rpm pickup 25, which is connected by a line 26 to an rpm meter n2, which in turn is connected to the process computer 9. Connected to the other rotatable tube carrying element 24 is a pulse transducer 27, which emits one pulse per rotation of the tube carrying element 24, and therefore also per rotation of the bobbin tube 17 and of the take-up bobbin 18 itself. The pulses are fed to a rotation counter Z2 of the process computer 9 through a pulse line 29.

A pulse transducer 28 is also disposed on the shaft 4 of the friction roller 3 and sends one pulse per rotation of the shaft 4 and therefore also per rotation of the friction roller 3, to a rotation counter Z1 of the process computer 9, through a pulse line 30.

The winding station 1 also has a control device 31 for ejecting a finished take-up bobbin 18 onto a conveyor belt 7 traveling in the direction of an arrow 6. A control line 32 connects the control device 31 to the process computer 9. The control device 31 has a pivotable arm 33, on the end of which a roller 34 is supported.

The process computer 9 has a divider D and comparator K.

The process computer 9 is also provided with set-point adjusters 35, 36 and a set-point transducer 37. The set-point or desired yarn length is set or adjusted at the set-point adjuster 35 and the set-point or desired cheese diameter is set or adjusted at the set-point adjuster 36. The set-point or desired ratio of yarn length to cheese diameter is set or adjusted at the set-point transducer 37. Correction values for slip between the friction drum and the cheese and for the conicity of the cheese can be adjusted at correction adjusters 46 and 47. Correction values for the yarn type and for the yarn crossing angle can be adjusted at further correction adjusters 50 and 51. In this exemplary embodiment, no further correction values are taken into account. The correction value for the yarn type automatically takes into account the type of fiber, the fiber mixture, the yarn fineness and all other yarn parameters that later have an influence on the ratio of yarn length to bobbin diameter.

A further counter Z3 of the electronic process computer 9 is connected through a pulse line 38 to a yarn cleaner 40. The counter Z3 counts the number of cuts performed by the cleaner, which is equivalent to the number of yarn interruptions during the bobbin travel. The number of yarn interruptions is dependent on the quality of the yarn, the quality of the winding station, the size of the cheese or take-up bobbin and the size of the feed bobbins or cops to be rewound.

A set-point or desired value of the number of cuts performed by the cleaner can be predetermined at the counter Z3 itself, so that when this set-point value is exceeded the control device 31 is blocked and the cheese 18 thus remains in the winding station and cannot be removed to the conveyor belt 7.

The winding station has to be shut down each time a spinning cop runs out of yarn and must be restarted after the yarn has been joined and after a new cop has been put in place. In the event of yarn flaws that lead to a cut performed by the cleaner, the winding station also has to be shut down, the yarn must be rejoined and the winding station must be restarted again.

Initially, the bobbin tube 17 rests on the friction roller 3.

In the starting phase, the lifting device 21 is out of operation. The switch protector 13 is switched on. The counters Z1, Z2, Z3, comparator K, divider D and rpm meters n1, n2 are in operation. The counter Z2 counts the rotations of the tube carrying element 24. The counter Z1 counts the rotations of the friction roller 3. The rotation signals are derived from the pulse transducers 27 and 28.

The rpm meters n1 and n2 continuously measure the rpm of the friction roller 3 and the cheese 18. The number of rotations of the friction roller 3 picked up by the counter Z1 is a measure of the yarn length that has been wound onto the cheese 18. The divider D forms the ratio n2 : n1 which is a ratio of the rpm of the cheese to the rpm of the friction roller. The result is a measure of the cheese diameter. At the same time the divider D forms the ratio of yarn length to cheese diameter and sends it to the comparator K. The actual-value ratio of yarn length to cheese diameter is compared continuosly in the comparator K, in a first mode of operation, with the set-point ratio of yarn length to cheese diameter predetermined by the set-point transducer 37. As soon as the actual-value ratio tends to deviate upward or downward from the set-point ratio, the comparator K causes the process computer 9 to regulate an electromagnet drive 45 and a yarn tensioner 42 by controlling the yarn tension through a control line 43, in such a way that the actual-value ratio of yarn length to cheese diameter remains in agreement with the set-point ratio within tolerance limits. If this is not successfully done, then the process computer 9 switches off the motor 5 through the control line 14 and the switch protector 13 and lifts the creel 15, 16 through the control line 22 and the lifting device 21, in order to lift the cheese 18 from the friction roller 3. However, in this case the removal of the cheese 18 to the conveyor belt 7 continues to be prevented.

The schematic illustration of the set-point value transducer 37 provided in the drawing shows the set-point course of the cheese diameter in a solid curve, as a function of the yarn length. The yarn length is plotted on the abscissa and the cheese diameter on the ordinate. The set-point values may, for example, also take the course represented by the curves shown in dashed lines or dot-dash lines.

As this diagram shows, the set-point ratio of yarn length to cheese diameter is generally not constant during the bobbin travel.

In a second mode of operation, the comparator K reacts to the set-point adjusters 35 and 36 and not to the set-point transducer 37.

The winding process is ended whenever either the set-point or desired yarn length adjusted at the set-point adjuster 35, or the set-point or desired cheese diameter adjusted at the set-point adjuster 36, is attained. At this instant the comparator K compares the actual ratio of yarn length to the cheese diameter with a set-point ratio, which results from or is calculated from the adjustments of the set-point adjusters 35 and 36. If the actual ratio is within tolerance limits of the set-point ratio, then the winding station 1 is shut down in the manner described below and the control device 31 is also actuated, in order to remove the completely wound cheese 18 to the conveyor belt 7, having identified it as a high-quality cheese.

If the actual ratio of yarn length to cheese diameter does not agree with the set-point ratio within tolerance limits, then the control device 31 remains blocked. The cheese 18 does not meet the set quality and must be changed by hand.

As a further criterion for the quality of the cheese, the result of counting with the counter Z3 can be used. A maximum number of tolerable cuts, such as 30 cuts performed by the cleaner, can be predetermined at the counter Z3. If the cheese 18 undergoes more than 30 cuts performed by the cleaner during the bobbin travel, then it continues to be wound to completion but is not removed to the conveyor belt 7, regardless of whether or not the actual ratio of yarn length to cheese diameter agrees with the set-point ratio.

Whenever a cheese 18 is not automatically removed as a high-quality cheese, a warning signal is sent through a control line 44 to a report device 41, in order to notify a machine maintenance worker of the situation.

The shutoff of the winding station 1 can be initiated by means of a shutoff pulse sent from the yarn cleaner 40 through the control line 48 to the electronic computer 9. This takes place if there is a yarn flaw that trips a cut performed by the cleaning, if the feed bobbin becomes empty and if the yarn fails to appear for other reasons.

A yarn interruption may, for example, be automatically taken care of by means of a non-illustrated automatic splicing or knotting machine. Subsequently, a starting pulse is sent to the computer 9 through a further control line 49, and the computer then trips and controls a starting process as described above.

In ascertaining the yarn length and the cheese diameter, the measured values used for this purpose are corrected by means of the correction factors set at the correction adjusters 46, 47, 50 and 51. Such correction factors need not be specified, if the set-point values set at the set-point value adjusters 35 and 36 already take such correction factors into account.

We claim:

1. Method for sorting cheeses on an automatic winding machine, which comprises predetermining a set-point value ratio of yarn length to cheese diameter, automatically measuring an actual value ratio of yarn length to cheese diameter, automatically comparing the measured values with the set-point values, and automatically selecting cheeses for which the actual value ratio of yarn length to cheese diameter is within a predeterminable range of the set-point value ratio as quality cheeses.

2. Method according to claim 1, which comprises automatically measuring the rotational angle and the number of rotations of a friction drum frictionally contacting and driving the cheese, and setting the result of the measurement equal to the yarn length.

3. Method according to claim 1, which comprises automatically measuring the rotational angle and the number of rotations of a friction drum frictionally contacting and driving the cheese, automatically converting the result of the measurement into another yarn length measure, and using the other yarn length measure for determining the actual value ratio of yarn length to cheese diameter.

4. Method according to claim 3, which comprises selecting the other yarn length measure as a metric measure.

5. Method according to claim 1, which comprises automatically measuring the rpm of the cheese and of a friction drum frictionally contacting and driving the cheese, forming a ratio of the rpm of the cheese to the rpm of the friction drum, and using the ratio of the rpm of the cheese to the rpm of the friction drum for calculating the cheese diameter.

6. Method according to claim 1, which comprises automatically measuring the rpm of the cheese and of a friction drum frictionally contacting and driving the cheese, forming a ratio of the rpm of the cheese to the rpm of the friction drum, automatically converting the ratio of the rpm of the cheese to the rpm of the friction drum into another measure of the cheese diameter, and using the other measure for determining the actual ratio of yarn length to cheese diameter.

7. Method according to claim 6, which comprises selecting the other measure of the cheese diameter as a metric measure.

8. Method according to claim 1, which comprises automatically correcting the measurement values previously used for ascertaining at least one of the yarn length and the cheese diameter with correction values, and selecting the correction values as at least one value from the group consisting of slippage between the cheese and a friction drum driving the cheese, the conicity of the cheese, the maximum diameter of the cheese, the type and surface quality of the friction drum, the yarn type, and the angle at which yarn windings intersect.

9. Method according to claim 1, which comprises continuously ascertaining the actual ratio of yarn length to cheese diameter during bobbin travel, and comparing the actual ratio of yarn length to cheese diameter with set-point values.

10. Method according to claim 1, which comprises automatically controlling yarn winding tension for influencing an instantaneous actual ratio of yarn length to cheese diameter.

11. Method according to claim 1, which comprises automatically setting a signal at any winding station of the automatic winding machine at which the measured actual ratio of yarn length to cheese diameter is outside the range of the set-point values.

12. Method according to claim 1, which comprises preventing automatic replacement of the cheese with an empty bobbin tube at any winding stations at which the measured actual ratio of yarn length to cheese diameter is outside the range of the set-point values.

13. Method according to claim 1, which comprises automatically counting the number of yarn breaks as further criteria for bobbin quality, and automatically selecting only cheeses in which the number of yarn breaks during bobbin travel does not exceed a predetermined maximum number as quality cheeses.

14. Method according to claim 1, which comprises automatically counting the number of cuts performed by a yarn cleaner as further criteria for bobbin quality, and automatically selecting only cheeses in which the number of cuts performed by the cleaner during bobbin travel does not exceed a predetermined maximum number as quality cheeses.

15. Method according to claim 1, which comprises automatically counting the number of yarn breaks and the number of cuts performed by a yarn cleaner as further criteria for bobbin quality, and automatically selecting only cheeses in which the number of yarn breaks and the number of cuts performed by the cleaner during bobbin travel does not exceed a predetermined maximum number as quality cheeses.

16. Method according to claim 1, which comprises displaying a survey of the number of quality cheeses produced at individual winding stations of the automatic winding machine by means of an electronic informer, at the end of a work shift.

17. Method according to claim 1, which comprises printing out a survey of the number of quality cheeses produced at individual winding stations of the automatic winding machine by means of an electronic informer, at the end of a work shift.

18. Method according to claim 1, which comprises displaying and printing out a survey of the number of quality cheeses produced at individual winding stations of the automatic winding machine by means of an electronic informer at the end of a work shift.

19. Method according to claim 1, which comprises predetermining a plurality of set-point values from each of several set-point value categories, and classifying quality cheeses according to a correspondingly high number of quality levels.

20. Method according to claim 1, which comprises marking or labelling selected quality cheeses in accordance with quality characteristics thereof.

* * * * *